US006922463B2

(12) United States Patent
Tang et al.

(10) Patent No.: US 6,922,463 B2
(45) Date of Patent: Jul. 26, 2005

(54) THERMALLY HIGH CONDUCTIVE HV CONNECTOR FOR A MONO-POLAR CT TUBE

(75) Inventors: Liang Tang, Waukesha, WI (US); Madhusudhana Talneru Subraya, New Berlin, WI (US); Paul Neitzke, Menominee, WI (US)

(73) Assignee: GE Medical Systems Global Technology Company, LLC, Waukesha, WI (US)

( * ) Notice: Subject to any disclaimer, the term of this patent is extended or adjusted under 35 U.S.C. 154(b) by 222 days.

(21) Appl. No.: 10/294,102

(22) Filed: Nov. 14, 2002

(65) Prior Publication Data

US 2004/0096037 A1 May 20, 2004

(51) Int. Cl.[7] ..... G21G 4/00
(52) U.S. Cl. ..... 378/119; 378/142; 174/138
(58) Field of Search ..... 378/119, 117, 378/123, 101, 142, 128; 439/183, 611, 602; 174/138

(56) References Cited

U.S. PATENT DOCUMENTS

| | | | | | |
|---|---|---|---|---|---|
| 4,427,256 | A | * | 1/1984 | Reif et al. | 439/584 |
| 4,494,811 | A | * | 1/1985 | Palermo, Jr. | 439/271 |
| 5,154,638 | A | * | 10/1992 | Sireul et al. | 439/611 |
| 5,947,758 | A | * | 9/1999 | Enck | 439/181 |
| 6,362,415 | B1 | * | 3/2002 | Snyder et al. | 174/15.1 |
| 6,545,398 | B1 | * | 4/2003 | Avnery | 313/361.1 |
| 2004/0028184 | A1 | * | 2/2004 | Hansen | 378/123 |

* cited by examiner

*Primary Examiner*—Edward J. Glick
*Assistant Examiner*—Irakli Kiknadze
(74) *Attorney, Agent, or Firm*—Peter J. Vogel

(57) ABSTRACT

An HV connector for high power X-ray device consists of thermally conductive epoxy, cable terminal, faraday cup, spring-loaded contact, and lead lined housing. The thermally conductive epoxy includes fillers. The epoxy can also be loaded with gravels of similar materials. A Faraday cup is included in the center area to offer electric field relief. Spring-loaded contacts are included for the easiness of pin alignment and robustness of handling. An efficient thermal management solution is accomplished through proper selection of thermal conductivities of gasket and epoxy.

18 Claims, 5 Drawing Sheets

THERMALLY HIGH CONDUCTIVE HV CONNECTOR FOR A MONO-POLAR CT TUBE

RELATED APPLICATION

The present invention is related to application Ser. No. 10/294,857 entitled "HV System For A Mono-Polar Ct Tube" filed simultaneously herewith and incorporated by reference herein.

TECHNICAL FIELD

The present invention relates generally to imaging systems and more particularly to an improved apparatus for connecting a high voltage (HV) electric cable to an X-ray tube.

BACKGROUND

Typical rotating anode X-ray tubes include a beam of electrons directed through a vacuum and across a very high voltage (on the order of 100 kilovolts) from a cathode to a focal spot position on an anode. X-rays are generated as electrons strike the anode, which typically includes a tungsten target track, which is rotated at a high velocity.

The conversion efficiency of X-ray tubes is relatively low, i.e. typically less than 1% of the total power input. The remainder is converted to thermal energy or heat. Accordingly, heat removal, or other effective procedures for managing heat, tends to be a major concern in X-ray tube design.

HV electric power cables are typically used to provide the requisite over 100 kilovolt potential difference between the cathode and anode, in order to generate the aforementioned X-rays. One end of the cable is connected to a power source, and the other end is connected to the tube, for connection to the cathode, by means of an HV connector assembly. The connector assembly generally includes a holding structure for maintaining the end of the cable with respect to the tube, such that the end portion of the cable conductors can be joined to a tube. The cable conductors typically include either a single conductor or a number of conductors.

The connector assembly further includes a quantity of HV insulation surrounding any exposed portion of the cable conductors which lie outside the tube. The HV insulation is joined to the X-ray tube and is relatively thick, in relation to the high voltage of the cable conductors.

Generally, high voltage insulating materials, such as epoxy, also tend to be very poor thermal conductors. This creates undesirable results when an HV connector assembly is directly attached to an X-ray tube, such as across an end thereof.

As stated above, a large quantity of heat is generated in the X-ray tube, as an undesired byproduct of X-ray generation. A portion of this heat is directed against the connector insulation material, which has a comparatively large area contacting the tube. Because of its poor thermal conductive properties, this insulator serves as a heat barrier such that a substantial amount of heat tends to accumulate proximate to the connector. Resultantly, the temperature limits of the connector insulation may be readily exceeded, such that the steady state performance of an X-ray tube is limited.

To improve clinic throughput, X-ray tube designers are facing an ever-increasing demand for more power. Traditionally, CT tubes have included a bi-polar HV system to generate X-ray beams, where a cathode and anode operate at 70 kV under different polarities. A bi-polar HV system typically uses a Federal standard receptacle/plug to bring the HV into the tube casing, where HV connections are made in oil through HV Feedthrough to a tube insert.

HV components within bipolar systems are rated on the order of 70 kv. In an effort to allow more tube peak power, a configuration with mono-polar HV system has been implemented. A mono-polar tube operates at 140 kV with negative polarity and includes a grounded anode electrode.

Mono-polar systems have numerous challenges in terms of HV clearance, discharge activities due to a much higher operating voltage, and constrained dimensions. Conical insulators/plugs have been implemented for such configurations. Several reliability and performance issues have been identified, however, due to thermal stress and material degradation of these conical devices. Conical HV insulation is therefore generally not a viable option for high power tubes.

One of major challenges an HV connector faces is HV integrity under high power conditions. For a continuous high power application, connector temperatures may exceed material limits. Consequently a catastrophic failure may occur through electric breakdown due to thermal runaway or long term discharges from associated material degradation, related to excessive temperatures.

Typical HV solutions often have difficulties handling high temperature scenarios including temperatures in excess of 150° C. Components that include EPR rubber, which is only rated at 105° C. continuously, are of great concern for such applications.

The disadvantages associated with current X-ray systems have made it apparent that a new technique for HV connection to X-ray systems is needed. The new technique should include robust response to thermal stress and should also prevent material degradation, while still maintaining a superior HV performance. The present invention is directed to these ends.

SUMMARY OF THE INVENTION

In accordance with one aspect of the present invention, an HV connector system for a mono-polar X-ray device includes a first side including a gasket wherein the gasket defines a central opening for accommodating the part of Faraday cup. The system also includes a second side disposed substantially parallel to the first side, and an outer edge disposed between the first side and the second side and coupled thereto. The outer edge includes a cable terminal adapted to receive an HV cable. A thermally conductive epoxy is enclosed in the cylindrical shielded housing, and a Faraday Cup is surrounded by the epoxy and coaxial with the central opening, the shielded device adapted to electrically couple to an HV cable and an X-ray device.

In accordance with another aspect of the present invention, a method for assembling an HV system for a mono-polar X-ray device includes coupling a cylindrical lead-lined HV connector to an X-ray device. The HV connector is mounted to the flange of the X-ray device (tube casing) through multiple spring-loaded bolts. Preloading is applied so that the gasket between HV insulator (ceramic) and connector is compressed. To improve the intimate contact and prevent voids along the gasket interfaces, a thin layer of silicone grease is applied to interfaces.

One advantage of the present invention is that the Faraday Cup offers substantial relief in local electric fields in the vicinity of HV wiring joints, which reduces partial discharge activities. Another advantage is thermal management with different thermal conductivities of gasket and epoxy based materials.

Additional advantages and features of the present invention will become apparent from the description that follows and may be realized by the instrumentalities and combinations particularly pointed out in the appended claims, taken in conjunction with the accompanying drawings.

BRIEF DESCRIPTION OF THE DRAWINGS

For a more complete understanding of the invention, there will now be described some embodiments thereof, given by way of example, reference being made to the accompanying drawings, in which.

DETAILED DESCRIPTION

The present invention is illustrated with respect to an HV connector system, particularly suited to the medical field. The present invention is, however, applicable to various other uses that may require HV connector systems, as will be understood by one skilled in the art.

Figure 1:
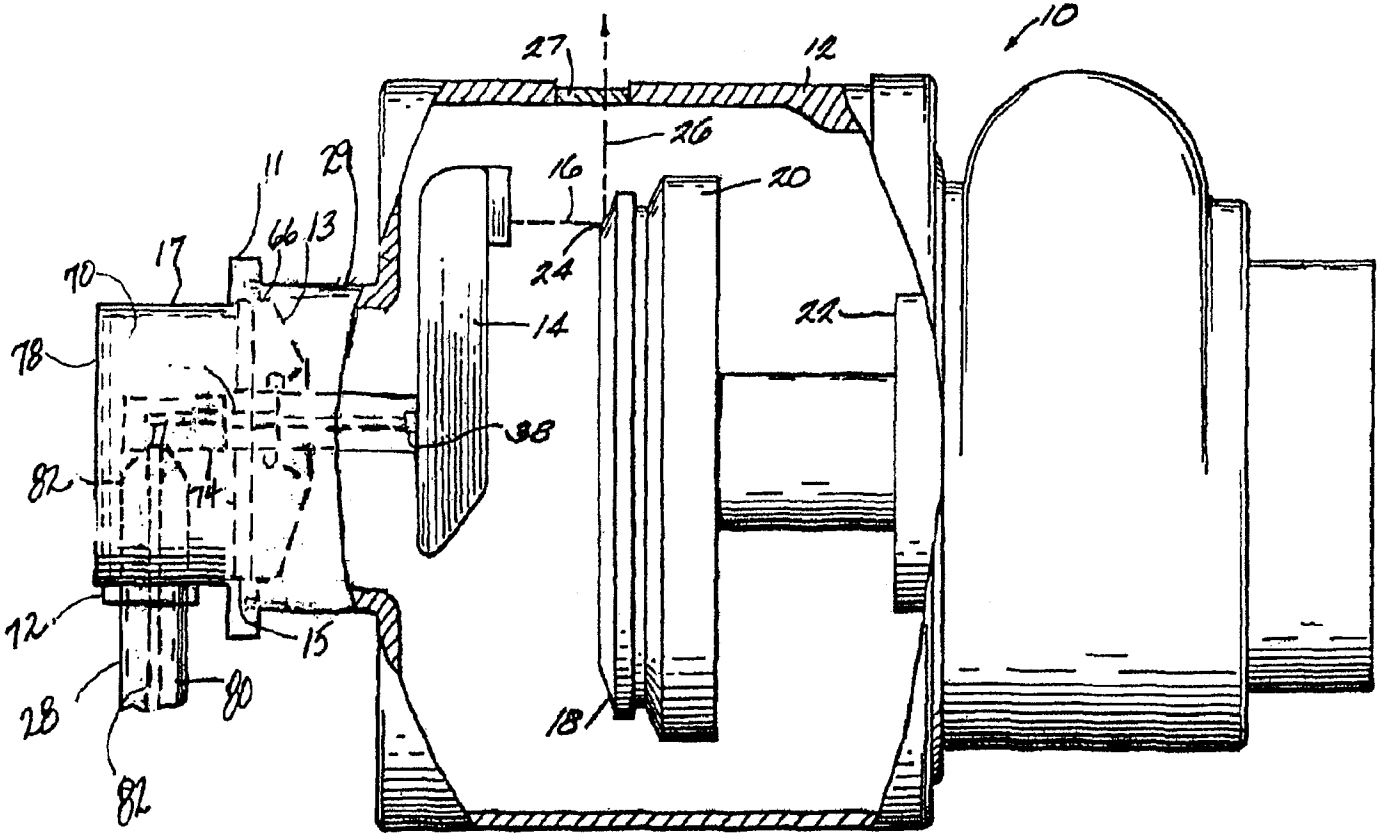
FIG. 1 is a perspective view with a section broken away illustrating an X-ray tube system according to one embodiment of the present invention.

Referring to FIG. 1, an X-ray tube system 10 (X-ray device) including an HV system 11 coupled to a metal housing 12, which supports other X-ray tube components, in accordance with a preferred embodiment of the present invention, is illustrated.

Figure 2:
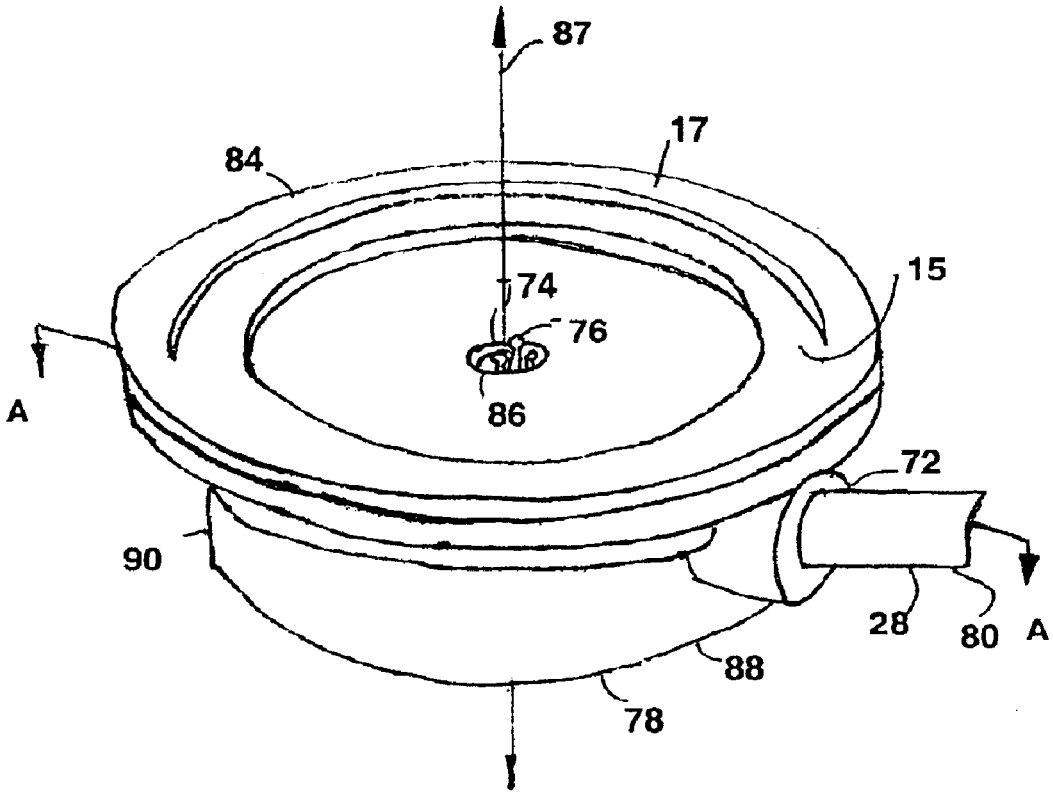
FIG. 2 is a perspective view of an HV connector according to FIG. 1.
Figure 2A:
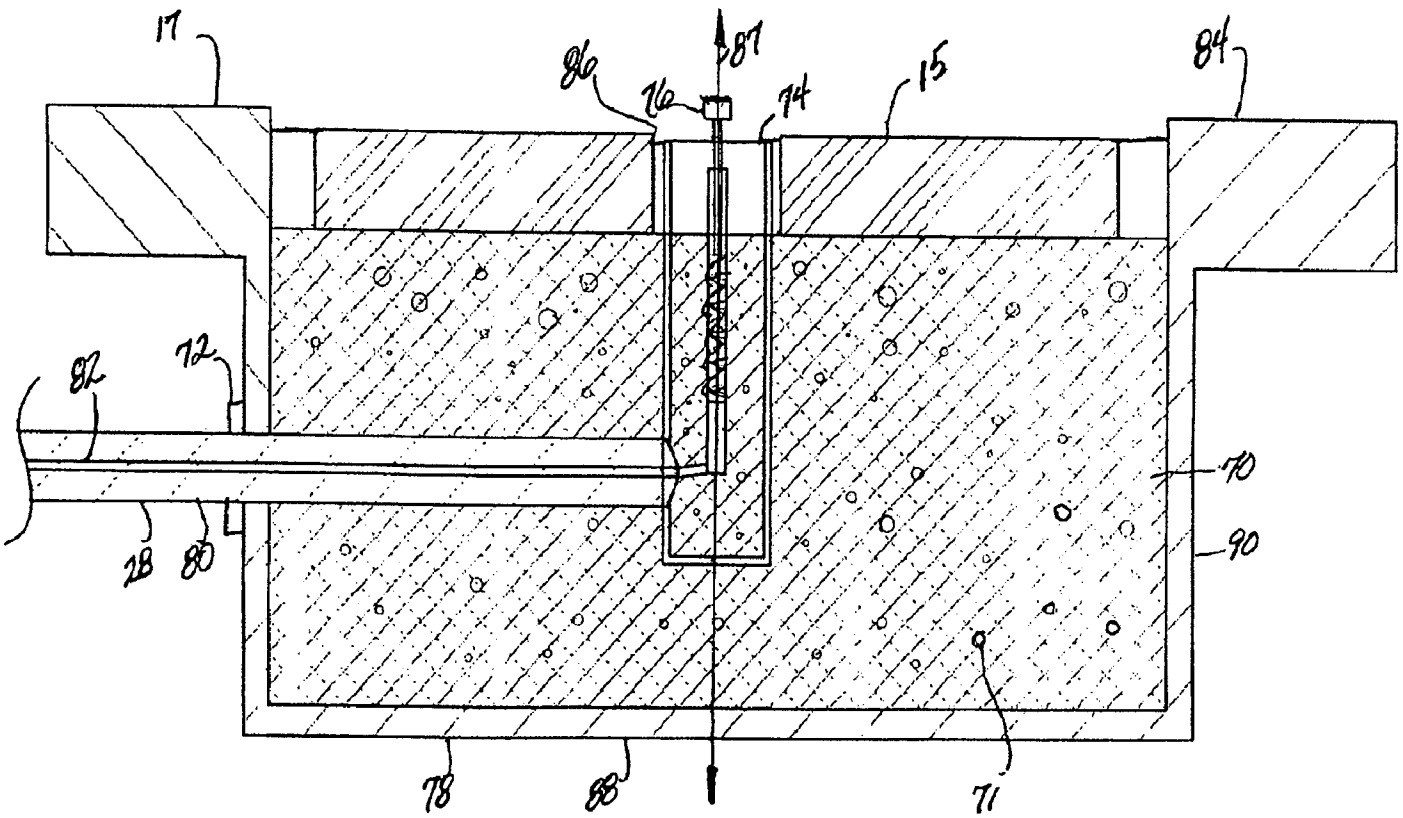
FIG. 2A is a sectional view of FIG. 2 in the direction of A—A.
Figure 2B:
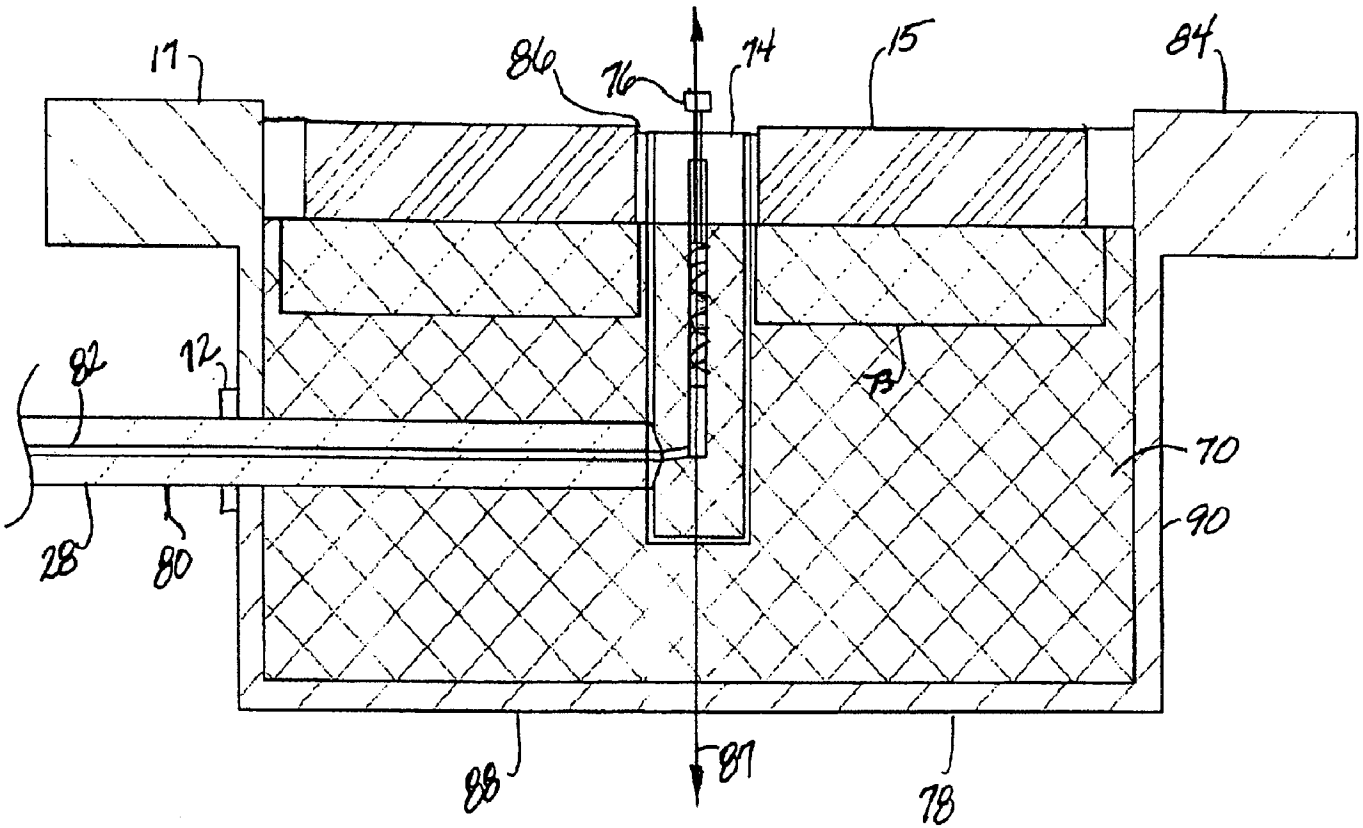
FIG. 2B is a sectional view of FIG. 2 in the direction of A—A according to another embodiment of the present invention.
Figure 3A:
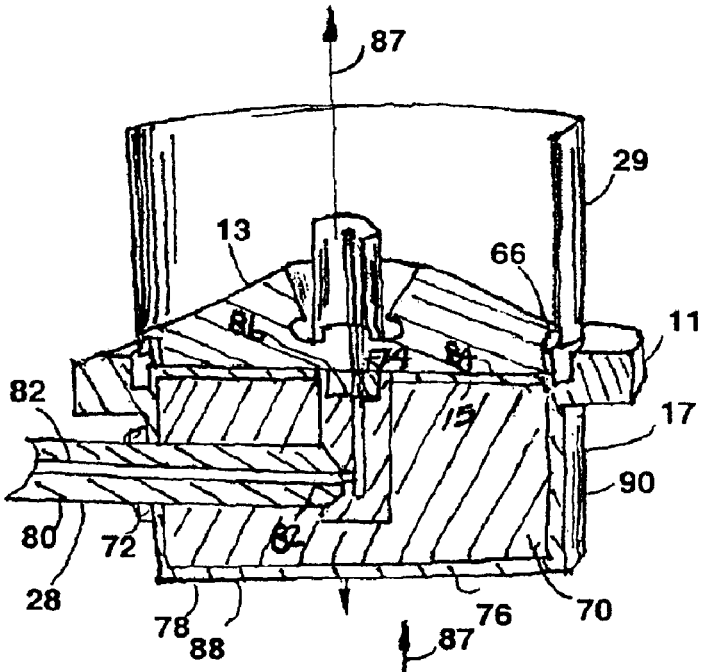
FIG. 3A is a sectional view of FIG. 3 in the direction of A—A.
Figure 3:
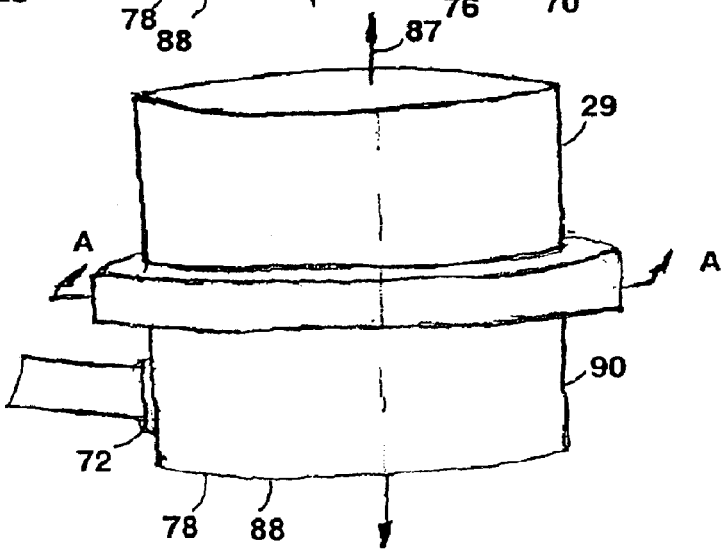
FIG. 3 is a perspective view of the HV connector system according to another embodiment of the present invention.

The HV system 11, which includes an HV insulator 13, a gasket 15, and an HV connector 17, will be discussed in detail with regards to FIGS. 2, 3 and 3A.

The metal housing 12 includes a cathode 14, and a protective vacuum enclosure for the cathode 14. The cathode 14 directs a high energy beam of electrons 16 onto a target track 18 of an anode 20, which includes a refractory metal disk and is continually rotated by means of a conventional mounting and drive mechanism 22. Target track 18 has an annular or ring-shaped configuration and typically includes a tungsten based alloy integrally bonded to the anode disk 20. As anode 20 rotates, the electron beam from cathode 14 impinges upon a continually changing portion of target track 18 to generate X-rays, at a focal spot position 24. A beam of X-rays 26 generated thereby is projected from the anode focal spot through an X-ray transmissive window 27 provided in the side of housing 12.

In order to generate X-rays as described above, there must be a potential difference on the order of 100 kilovolts between cathode 14 and anode 20. In a mono-polar tube arrangement this is achieved by connecting the anode to a ground (not shown), and applying power at the required 100 kilovolt range to cathode 14 through an electric cable 28. Because of the high voltage carried by cable 28, it is necessary to use the HV connector 17 for coupling the cable 28 to cathode 14.

The HV system 11 includes an HV insulator 13 in an insulator housing 29 and coupled to a gasket 15, which is coupled to an HV connector 17. The embodied HV system includes the aforementioned components coaxial along axis 87, however, numerous other arrangements are included, as will be understood by one skilled in the art.

The HV connector 17 includes a thermally conductive epoxy 70, cable terminal 72, Faraday Cup 74, spring-loaded contacts 76, and lead-lined Al housing 78.

Referring to FIGS. 1, 2, 2A, 2B, 3 and 3A, the HV connector 17 includes a cylindrical shielded housing (lead-lined Al housing 78) including a first side 84 (top side relative to the FIGURES) including a gasket 15 wherein the gasket 15 defines an opening 86 that accommodates part of the Faraday cup. The HV connector 17 also includes a second side 88 (bottom side relative to the FIGURES) disposed substantially parallel to the first side 84, and an outer edge 90 disposed between the first side 84 and the second side 88 and coupled thereto. The outer edge 90 includes a cable terminal 72 adapted to receive an HV cable 28. A thermally conductive epoxy 70 is enclosed in the cylindrical shielded housing 78, and a Faraday Cup 74 is surrounded by the epoxy 70, the Faraday Cup 74 is adapted to electrically couple to an HV cable 28 and the electric coupling element 38, which will be discussed later.

In order to insulate the exposed end portion of conductors 38, that is, the portion extending between the end of insulator 80 and insulator 13 within tube 10, the HV connector housing 78 is filled with electrical insulating material such as epoxy 70. The thermally conductive epoxy 70 includes fillers such as $Al_2O_3$, or AlN, or BN powders. To further increase the thermal conductivity, the epoxy 70 is alternately loaded with gravels 71 of similar materials, as in FIG. 2A. Also, a block of $Al_2O_3$ 73 can be used as part of thermal conduction path as well as HV insulation in epoxy, as in FIG. 2B.

Furthermore, the HV connector 17 offers an efficient thermal management solution through selection of thermal conductivities of gasket 15 and epoxy 70. For example, using a gasket with a high conductivity and epoxy with a low conductivity provides a heat path, directing heat flow to the housing through gasket. As a result, a significant amount of heat is shunted from getting into the connector. Alternately, using an epoxy with high thermal conductivity and a gasket with low conductivity provides a barrier to prevent heat from getting into the connector 17. Additionally, to improve the intimate contact and prevent voids along the gasket interfaces, a thin layer of silicone grease is applied to interfaces.

The Faraday Cup 74 in the center area offers shielding of the electric field to the vicinity, which reduces the undesirable partial discharge. Within the Faraday Cup 74, the electric field is reduced to a negligible level. The HV joint and connection are well protected from discharges.

Spring-loaded contacts 76, such as a spring-loaded pogo pin, simplify pin alignment and robustness for handling. An Inconel can be used as spring material for a higher temperature limit. The spring loading increases contacting effectiveness of the HV connection between HV insulator 13 and HV connector 17 under various thermal conditions.

The HV connector 17 (lead-lined HV connector) encloses a thermally conductive epoxy 70 and is coupled to the flange 66 of the insulator housing 29, the HV connector 17 further includes an HV cable terminal 72.

The HV connector 17 includes the lead-lined housing 78, which is joined to the tube housing 12, such as at an end thereof or through the insulator housing 29, is illustrated. The lead-lined housing 78 is embodied as including alternate materials, such as aluminum.

The insulator 13 is included to improve the overall HV stability in a vacuum. The insulator profile is optimized to avoid surface flashover. The electric stress at the triple point is minimized through metallization (i.e. the triple point is shifted), thereby mitigating discharge activities. The insulator shape, as illustrated, is designed such that the insulator 13 has optimal HV performance in terms of preventing surface flashover and bulk breakdown of ceramic. It is to be understood that the illustrated insulator is one of the numerous possible insulators to be used in the present invention, as will be understood by one skilled in the art.

Referring again to FIGS. 1, 3 and 3A, a slightly-tapered gasket 15 is used for the electrical, thermal, and mechanical reasons. The gasket 15 is embodied as having a thick center and slightly thinner edges, however alternate embodiments include a uniform gasket. The gasket 15 is ideally made of silicone material (or a comparable substitute thereof) and is under compression with a load of 15 to 30 psi when the spring-loaded connector 17 pushes against the flat surface of ceramic insulator 13. The close contact ensures the HV integrity along all interfaces therefore HV performance.

The HV cable 28 including electric conductor or conductors 82 positioned along the center of the cable 28, and a layer of HV insulation 80 surrounding conductors 82. As stated above, there may be a single solid conductor 82 or a number of conductors. The HV cable 28 is coupled to the HV cable terminal such that the HV cable contacts the Faraday Cup 74, or alternate conductive means, as will be understood by one skilled in the art.

The HV cable 28 is inserted into the HV connector 17, through an aperture 72 in connector housing 78. The aperture 72 is typically positioned trans-axially to axis 87. Conductors 82 extend beyond the end of insulation layer 80, and are directed through the Feedthrough on HV insulator 13 and mated with an electric coupling element 38, joined to cathode 14. The electric coupling element 38 and cathode 14 are supported in place by HV insulator 13, inserted into the end of tube 10 and formed of ceramic material or the like.

Conductors 82 typically include copper, and insulator 80 includes a material such as EP rubber. Such material provides the HV cable 28 with flexibility and, at the same time, provides sufficient insulation for the high voltage electric power carried thereby.

In operation, the X-ray source is activated and high voltage charge travels through the HV conductor and into the Faraday Cup. Concurrently, the HV insulator is minimizing the electric fields and potential discharges through the unique design described previously.

From the foregoing, it can be seen that there has been brought to the art a new HV connector system 10. It is to be understood that the preceding description of the preferred embodiment is merely illustrative of some of the many specific embodiments that represent applications of the principles of the present invention. Numerous and other arrangements would be evident to those skilled in the art without departing from the scope of the invention as defined by the following claims.

What is claimed is:

1. An HV connector system for a mono-polar X-ray device comprising:

a cylindrical shielded housing comprising a first side comprising a gasket wherein said gasket defines a central opening, a second side disposed substantially parallel to said first side, and an outer edge disposed between said first side and said second side and coupled thereto, said outer edge comprising a cable terminal trans-axial to said central opening and adapted to receive an HV cable;

a thermally conductive epoxy enclosed in said cylindrical shielded housing; and a Faraday Cup surrounded by said epoxy and disposed coaxially with said central opening, said Faraday Cup adapted to electrically couple to an HV cable and an X-ray device.

2. The system of claim 1 wherein said HV cable is coupled to said HV cable terminal such that said HV cable contacts said Faraday Cup.

3. The system of claim 1 wherein said epoxy comprises at least one of $Al_2O_3$ powder, AlN powder, BN powder, or gravels of similar materials.

4. The system of claim 1 wherein said epoxy comprises at least a block of $Al_2O_3$ disk to improve its thermal performance.

5. The system of claim 1 further comprising an insulator coupled to said gasket.

6. The system of claim 5 wherein said gasket is compressed between said insulator and said thermally conductive epoxy through a compressive force wherein said compressive force is at least partially from a spring loaded device.

7. The system of claim 1 wherein said gasket comprises silicone rubber or a substance with similar electrochemical properties to silicone rubber.

8. The system of claim 1 wherein said gasket is tapered.

9. An HV system comprising:

an X-ray device;

a cylindrical shielded housing coupled to said X-ray device, said cylindrical shielded housing comprising a first side comprising a gasket wherein said gasket defines a central opening, a second side disposed substantially parallel to said first side, and an outer edge disposed between said first side and said second side and coupled to said first side and said second side, said outer edge comprising a cable terminal trans-axial with said central opening and adapted to receive an HV cable;

a thermally conductive epoxy enclosed in said cylindrical shielded housing wherein said gasket is adapted to be compressed between an HV insulator and said thermally conductive epoxy; and a Faraday Cup coaxial with said central opening and surrounded by said thermally conductive epoxy, said Faraday Cup adapted to electrically couple to said HV cable and said X-ray device.

10. The system of claim 9 wherein said gasket is compressed between said HV insulator and said thermally conductive epoxy through a compressive force wherein said compressive force is at least partially from a spring loaded device.

11. The system of claim 10 wherein said gasket comprises silicone rubber or a substance with similar electrochemical properties to silicone rubber and wherein said gasket is tapered.

12. The system of claim 9 wherein said thermally conductive epoxy comprises at least one of $Al_2O_3$ powder, AlN powder, BN powder, or gravels of similar materials.

13. The system of claim 9 wherein said Faraday Cup is adapted to electrically couple to said HV cable and said X-ray device through spring-loaded contacts.

14. A method for assembling an HV system for a monopolar X-ray device comprising:

coupling a cylindrical lead-lined HV connector to a X-ray device, said cylindrical lead-lined HV connector comprising a first side comprising a gasket wherein said gasket comprises an opening, a second side disposed substantially parallel to said first side, and an outer edge disposed between said first side and said second side and coupled thereto;

compressing said gasket between an HV insulator and a thermally conductive epoxy; and surrounding a Faraday Cup with said epoxy, said Faraday Cup adapted to electrically couple to an HV cable and an X-ray device.

15. The method of claim 14 wherein compressing said gasket further comprises compressing said gasket between said HV insulator and said thermally conductive epoxy through a compressive force wherein said compressive force is at least partially from a spring loaded device.

16. The method of claim 14 wherein compressing further comprising optimizing thermal conductivities of said gasket and said thermally conductive epoxy.

17. The method of claim 14 wherein compressing further comprising selecting said gasket having a low thermal conductivity and said thermally conductive epoxy having a high thermal conductivity.

18. The method of claim 14 wherein compressing further comprising selecting said gasket having a high thermal conductivity and said epoxy having a low thermal conductivity.

* * * * *